US008733530B2

(12) United States Patent
Kallin

(10) Patent No.: US 8,733,530 B2
(45) Date of Patent: May 27, 2014

(54) ITEM RECYCLING

(75) Inventor: Fred Kallin, Waterloo (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/562,761

(22) Filed: Jul. 31, 2012

(65) Prior Publication Data

US 2014/0034445 A1 Feb. 6, 2014

(51) Int. Cl.
*G07F 7/04* (2006.01)
*B65H 5/02* (2006.01)

(52) U.S. Cl.
USPC ..... 194/206; 194/342; 271/4.06

(58) Field of Classification Search
USPC ..... 194/206, 342, 343, 350; 209/534; 235/379; 271/3.01, 6, 4.05, 4.06, 7, 271/10.07, 198
See application file for complete search history.

(56) References Cited

U.S. PATENT DOCUMENTS 4,363,584 A * 12/1982 Kokubo ..... 414/788.5

* cited by examiner

*Primary Examiner* — Mark Beauchaine
(74) *Attorney, Agent, or Firm* — Michael Chan

(57) ABSTRACT

A method and apparatus are disclosed for recycling items of media. The apparatus includes at least a pair of co-operable feed belt members that receive a depositable item of media at a first location and locate the depositable item at a stack position in a storage container. The apparatus also includes at least a pair of co-operable dispense belt members that selectively pivot between an operational and non-operational position. In the operational position, at least one of the dispense belt members is disposed to remove an item from the stack position and provide the removed item to the feed belt members. The feed belt members are arranged to locate an item of media received from the dispense belt members at said first location.

14 Claims, 7 Drawing Sheets

ITEM RECYCLING

FIELD OF THE INVENTION

The present invention relates to a method and apparatus for recycling items of media. In particular, but not exclusively, the invention relates to a recycler cassette used to store items of media and a mechanism for depositing items of media into the cassette and dispensing items of media from the cassette.

Various Self-Service Terminals (SSTs) are known in which items of media are repeatedly deposited in the terminal and/or dispensed from the terminal. For example, Automated Teller Machines (ATMs) utilize recycling modules to enable currency notes to be removed when desired from a storage cassette and also, when deposited by a user at a terminal, currency notes may be placed back into the currency cassette, thereby replenishing the stock stored.

Existing currency recycling modules tend to have very expensive currency cassettes because complex feeding and deposit mechanisms must be included inside the body of the cassette. Also, some proposed recycling mechanisms include a method of loading in which a throughput speed is slow in terms of loading new items of media into the storage cassette. It has until now proved to be difficult to develop a mechanism which can both dispense and load items of media into currency cassettes that is efficient to manufacture and not prone to operational error.

SUMMARY OF THE INVENTION

It is an aim of the present invention to at least partly mitigate the above-mentioned problems.

It is an aim of certain embodiments of the present invention to provide a method and apparatus for recycling items of media.

It is an aim of certain embodiments of the present invention to provide a method of recycling items of media in which a deposit and dispense drive belt mechanism may be selectively located through an opening in a storage container and thereafter, items of media be deposited or dispensed one-by-one through the opening via the respective belt mechanisms.

It is an aim of certain embodiments of the present invention to provide a method and apparatus whereby items of media may be dispensed from or deposited at a container in which they are held, one-by-one without risk of error.

It is an aim of certain embodiments of the present invention to provide a currency cassette which is locatable in an ATM or Teller Cash Recycler (TCR).

According to a first aspect of the present invention there is provided apparatus for recycling items of media, comprising:

at least a pair of co-operable feed belt members that receive a depositable item of media at a first location and locate the depositable item at a stack position in a storage container; and at least a pair of co-operable dispense belt members that selectively pivot between an operational and non-operational position; wherein in the operational position, at least one of the dispense belt members is disposed to remove an item from the stack position and provide the removed item to the feed belt members, said feed belt members being arranged to locate an item of media received from the dispense belt members at said first location.

Aptly, the apparatus further includes at least one selectively rotatable wheel element comprising a plurality of flapper members that urge an item of media against a one of the feed belt members in a respective pair as the wheel element rotates.

Aptly, the apparatus further includes at least one selectively rotatable wheel element that pivots with the dispense belt members and comprises a plurality of flapper members that urge an item of media removed from the stack position between the dispense belt members in a respective pair.

Aptly, the apparatus further includes at least a one feed belt member in each pair of feed belt members has a surface comprising a low co-efficient of friction.

Aptly, the apparatus further includes at least a one dispensed belt member in each pair of dispense belt members has a surface comprising a co-efficient of friction greater than the low co-efficient of friction.

Aptly, a portion of at least a one feed belt member extends below a surface of a floor of the storage container.

Aptly, a remainder one dispense belt member is a retard belt member comprising a co-efficient of friction less than said at least one dispense belt member and that moves in an opposite direction to the feed belt member in said operational position.

Aptly, the at least one dispense belt member, when in the operational position, is urged towards a pusher plate element of the storage container and is located nearer to a stack of remaining items of media in the storage container than a location of a feed belt member.

According to a second aspect of the present invention there is provided an Automated Teller Machine (ATM) or Teller Cash Recycler (TCR) which includes at least a pair of co-operable feed belt members that receive a depositable item of media at a first location and locate the depositable item at a stack position in a storage container; and at least a pair of co-operable dispense belt members that selectively pivot between an operational and non-operational position; wherein in the operational position, at least one of the dispense belt members is disposed to remove an item from the stack position and provide the removed item to the feed belt members, said feed belt members being arranged to locate an item of media received from the dispense belt members at said first location.

According to a third aspect of the present invention there is provided a method of recycling items of media, comprising the steps of:

storing an item of media in a storage container by receiving a depositable item of media at a first location and locating the depositable item in a stack position in the container via at least a pair of co-operable feed belt members; and dispensing an item of media from the storage container by selectively pivoting at least a pair of co-operable dispense belt members into an operational position and, via at least one of the dispense belt members, removing the item from the stack position and providing the item at the first location via the feed belt members.

Aptly, the method further includes the step of locating at least one item of media in the stack position by rotating an endless belt comprising a one of said pair of feed belt members and allowing the endless belt member to slip against a contact surface of an item of media subsequent to the item of media being located at the stack position.

Aptly, the method further includes the step of lifting at least one item of media from the stack position to thereby remove the item from the stack position, said lifting step comprising urging a portion of a rotating endless belt comprising the at least one dispense belt member against a contact surface of an item of media at the stack position, whereby friction moves said an item of media with the rotating endless belt.

Aptly, the method further includes the step of separating items of media lifted from the stack position by rotating a further endless belt member comprising a remaining one dispense belt member moving in an opposite direction with respect to a rotation direction of said at least one dispense belt member.

Aptly, the method further includes the step of urging remaining items of media stored in a stacked arrangement in the storage container towards the stack position via a biased pusher plate element.

According to a fourth aspect of the present invention there is provided a method of recycling items of media, comprising the steps of:

selectively locating a deposit and dispense drive belt mechanism through an opening in a storage container; and depositing and/or dispensing items of media one-by-one through the opening via the respective belt mechanisms.

According to a fifth aspect of the present invention there is provided a currency cassette, comprising:

a housing member that defines a storage chamber and comprises a floor, spaced apart side walls and an end wall at a first end thereof;

a pusher plate element in the storage container that is biased towards a further end of the housing member;

a first and further substantially parallel, spaced apart end wall member that closes a portion of the further end of the housing; and a shutter element locatable between the first and further end wall members; wherein the end wall members each comprise a first cut out region through which a respective feed belt member of at least a pair of co-operable feed belt members is locatable when the cassette is located in an Automated Teller Machine (ATM) or Teller Cash Recycler (TCR) and a further cut out region through which a respective dispense belt member of at least a pair of co-operable dispense belt members is pivotably locatable.

Aptly, the pusher plate element comprises at least one cut out region in registration with the location of flapper elements of a wheel element that pivots with the dispense belt members.

Certain embodiments of the present invention provide the advantage that a relatively uncomplicated cassette which has few (if any) moving parts and which is relatively cheap to produce can be utilized as a replenisher cassette. This is because the various mechanisms for depositing and dispensing items of media into and out of the cassette are separated and mounted in a terminal into which a cassette is locatable. As a result, a low cost cassette is achieved because the dispense and deposit mechanisms are not part of the cassette assembly.

Certain embodiments of the present invention provide the advantage that high speed operation is possible because of a friction feeding method of dispensing and depositing items.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
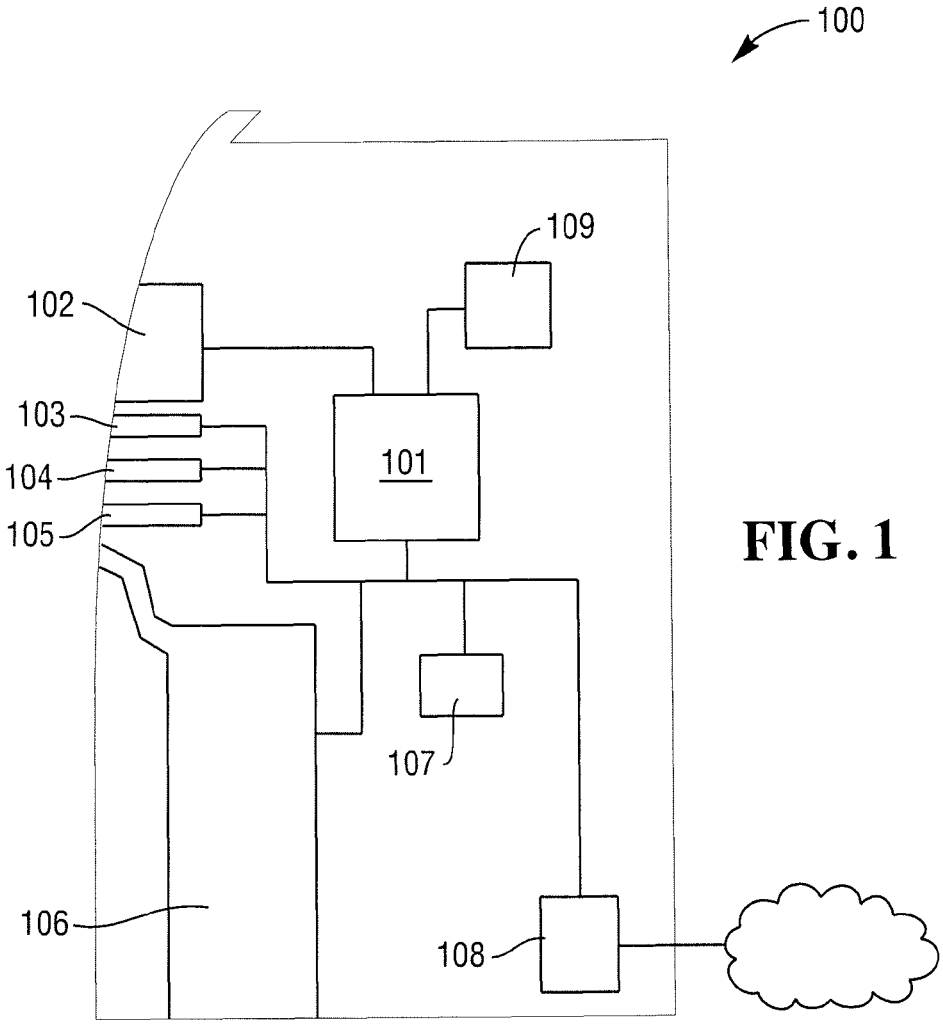
FIG. 1 illustrates a schematic diagram of a Self-Service Terminal in the form of an Automated Teller Machine (ATM)

In the drawings like reference numerals refer to like parts.

FIG. 1 illustrates a block diagram of a Self-Service Terminal (SST) 100 in the form of an Automated Teller Machine (ATM) according to one embodiment of the present invention. It will be understood that certain embodiments of the present invention are applicable to other types of terminal such as ATMs, vending machines, Teller Cash Recyclers (TCRs), change machines and the like. Likewise, items of media such as, but not limited to, currency notes, checks, tickets, giros and the like may be deposited at or dispensed from such terminals.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser/deposit module 106, a journal printer module 107 for creating a record of every transaction executed by the ATM, a connection module 108, an operator panel module 109 for use by a service operator (such as a field engineer, a replenisher (of currency, of printer paper or the like), or the like).

Certain customer transaction modules (such as the ATM controller 101) are also used by the service personnel for implementing management functions. However, some of the modules are referred to herein as service personnel modules (such as the journal printer module 107 and the operator panel module 109) because they are never used by ATM customers.

Figure 2:
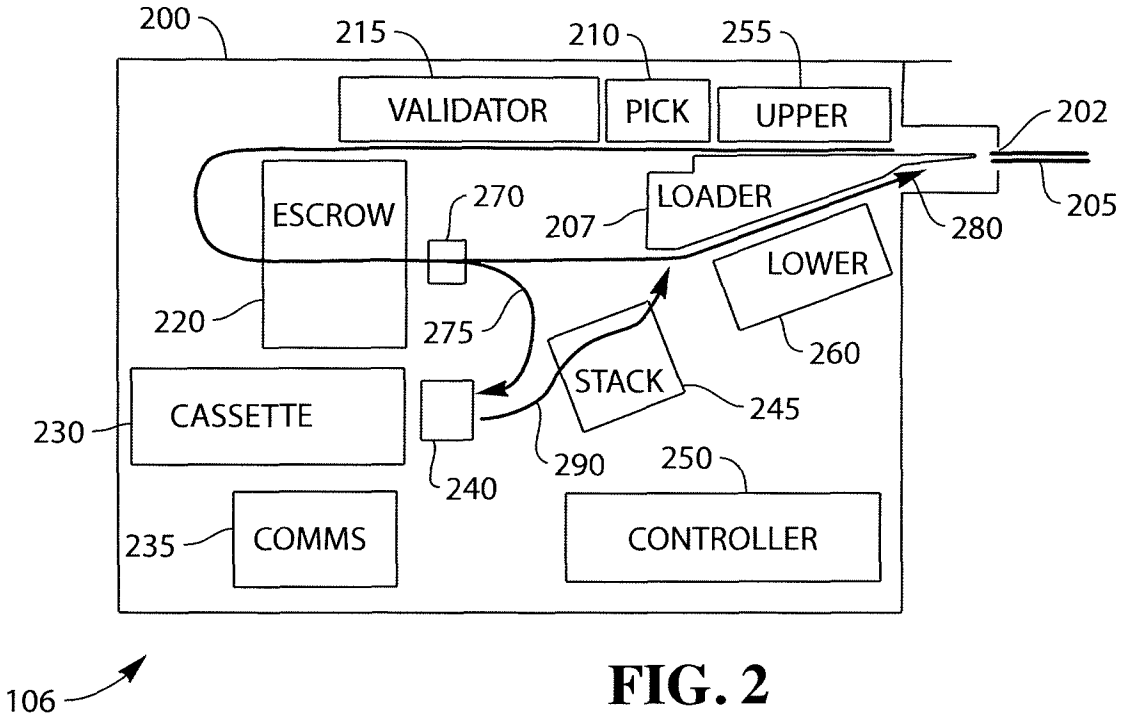
FIG. 2 illustrates a schematic diagram of a media dispenser/depository.

FIG. 2 illustrates a schematic diagram of an ATM media dispenser/deposit module 106. The ATM 100 includes at least one removable currency cassette 200, a pick/deposit unit 201 which operates to remove or deposit individual bank notes from or to the currency cassette 200, a transport section 202 for transporting bank notes, a stacker wheel 203 (instead of a stacker wheel a ballistic stacker or the like could be used). A presenter unit 204 presents a bunch of picked and collated bank notes to a customer. A controller 205 controls the operation of the pick/deposit unit 201 and a purge bin 206 stores incorrectly picked bank notes or bank notes not removed by a customer. These component parts are housed within a chassis 207.

The transport section 202 includes a vertical portion 208 for receiving a picked bank note from the pick/deposit unit 201 or delivering a bank note to the pick/deposit unit 201 and a horizontal portion 209 for conveying a bank note with respect to either to the stacker wheel 203 or the purge bin 206. The vertical portion 208 includes a conventional bank note thickness sensor 210 to detect multiple superimposed bank notes being transported erroneously as a single bank note. Any such superimposed bank notes may have to be diverted to the purge bin 206 via a divert path 211. The horizontal portion 209 comprises an upper guide 212 which is pivotably coupled to a lower guide 213 to permit access to any bank notes jammed therebetween so that the jammed bank note can be removed therefrom. The lower guide 213 includes a diverter (not shown) for routing a bank note (or multiple bank notes) to the divert path 211.

The transport section includes various belts and/or gears to transport currency notes and these belts and/or gears are all powered by a drive motor 215. The stacker wheel 203 is coupled to a stacker wheel motor 216. The stacker wheel motor 216 is coupled to the controller 205 by a control line 217.

The stacker wheel 203 comprises an axle 220 on which are mounted a plurality of mutually coupled but axially separated hubs (only one of which is shown in FIG. 2). Each hub includes a plurality of arcuate tines 221 disposed transverse to the axle on which the hubs are mounted. The hubs are mounted in registration so that the arcuate tines on one hub are aligned with the corresponding arcuate tines on all other hubs.

The hubs are rotated in unison as currency notes are fed towards the stacker wheel from the transport section. The rotation of the stacker wheel is synchronized with the speed at which currency notes are conveyed so that only one currency note is stored between adjacent tines on a hub. Other configurations for conveying notes between the cassette 200 and a user orifice of the terminal are of course possible.

Figure 3:
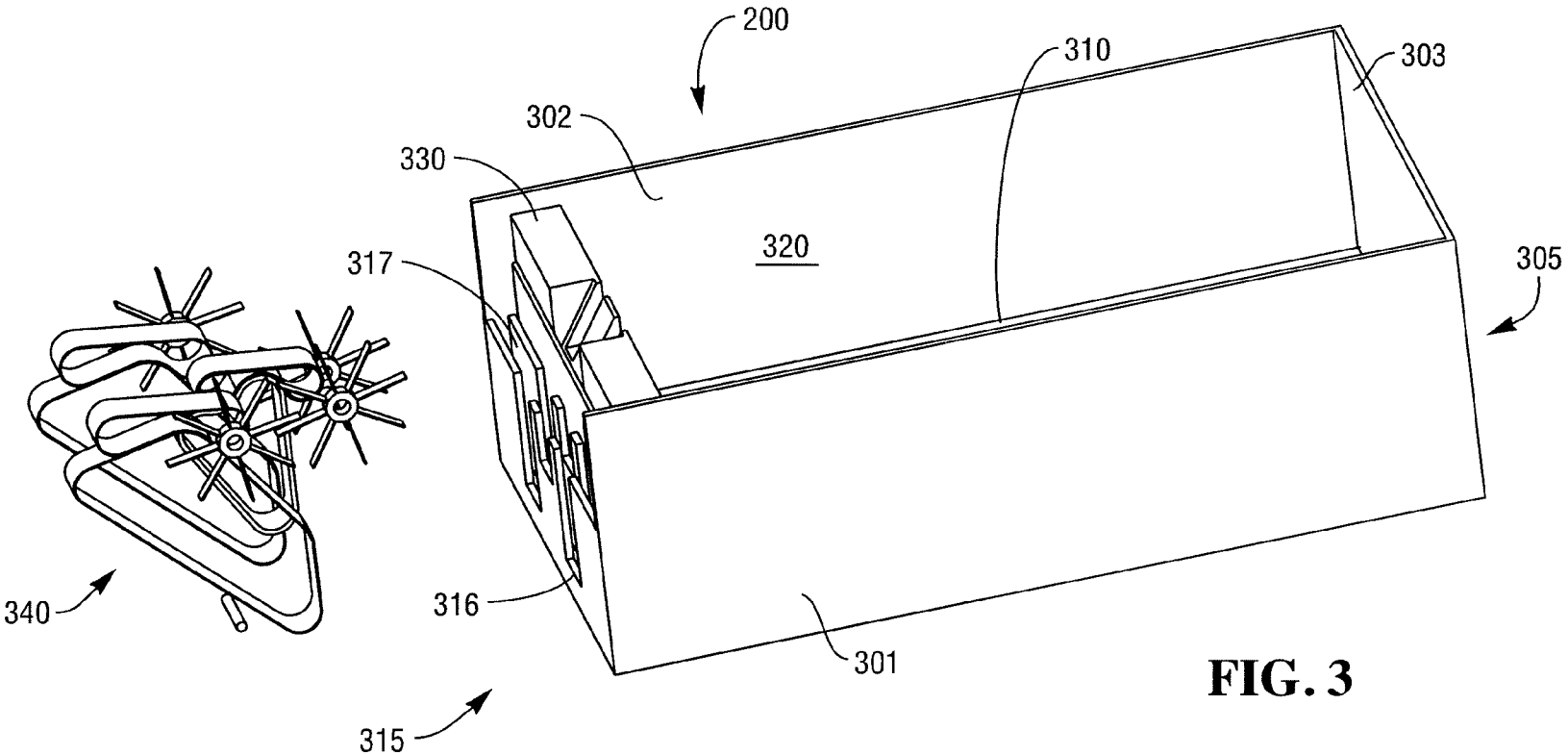
FIG. 3 illustrates a currency cassette and a drive and belt mechanism used to deposit and dispense items of media in/from the currency cassette.

FIG. 3 illustrates the currency cassette 200 in more detail. The currency cassette is a box-like container having a first and further side wall 301, 302 which are spaced apart from each other in a substantially parallel arrangement. An end wall 303 extends between these side walls at a first end 305 of the cassette. A base 310 extends as a floor between the side walls and the end wall 302. A remaining end 315 of the cassette is partially closed by a first and further substantially parallel spaced apart wall 316, 317. These partial end walls extend from the base but do not extend away from the base as far as the adjacent side walls. The partial end walls are separated from each other so that when a lid (not shown) and shutter (not shown) are in place, the shutter extends between the partial end walls securely closing access to the inner chamber region 320 of the cassette.

FIG. 3 also illustrates how a pusher plate 330 is located within the cassette chamber. This is continually biased towards the partial end walls 316, 317 to urge a stack of currency notes into an abutting relationship with an inner surface of the innermost partial end wall. The walls, floor and end walls provide a housing that defines the storage chamber 320. The storage chamber can hold many hundreds, or, in some optional examples, thousands of currency notes stacked along the longitudinal length of the cassette. As the notes are dispensed the stack is reduced in size but remaining notes remain in a stack ready for picking.

FIG. 3 also illustrates a drive belt system 340 which is formed as part of the ATM in which the currency cassette is located. As will be described hereinafter, various parts of the belt are pivotable away from or towards the currency cassette and are usable to deposit currency notes one-by-one in the currency cassette or help pick items of currency (i.e. currency notes) during a dispensing mode of operation. It will be understood that currency notes can be deposited into the cassette and then subsequently picked and dispensed to a further user to thereby recycle currency notes. In this sense, the cassette is a recyclable currency cassette.

The drive belt system is pivoted out of the way when a new cassette is to be introduced into the terminal. This position is shown in FIG. 3.

Figure 4:
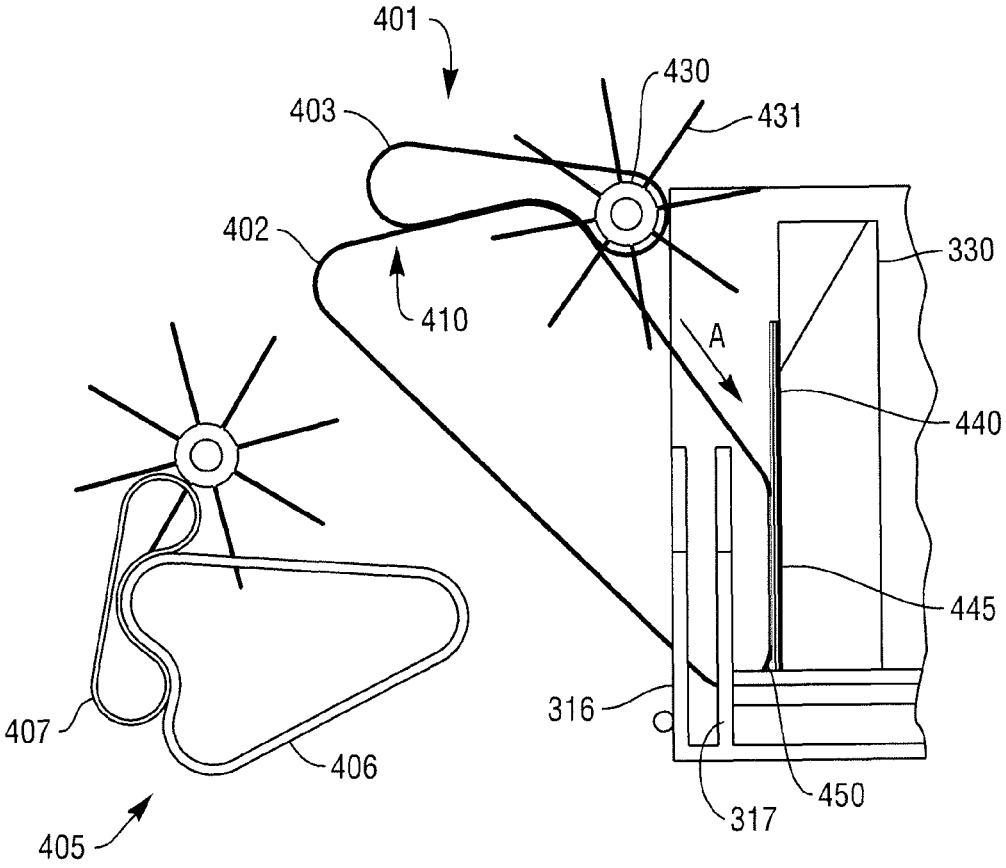
FIG. 4 illustrates feed belt members in a feed position via which items are deposited in the cassette.

As illustrated in FIG. 4, the belt mechanism 340 includes two major belt systems. A first belt system 401 is shown in an engaged mode of operation in FIG. 4 and includes a first feed belt 402 and co-operable further feed belt 403. A remaining belt system 405 is illustrated pivoted away from the cassette in a non-operational position. This belt system includes a first dispense belt 406 and a co-operable dispense belt 407. It will be understood that whilst a single pair of dispense belts 406, 407 is illustrated in FIG. 4 as part of the dispense belt sub-system, this sub-system actually includes a pair of spaced apart belts. This is shown more clearly in the other figures. It will be appreciated that each of the sub-systems may include one, two, three or more pairs of co-operable belt members.

In a deposit mode of operation, currency notes are deposited by a user of the ATM and must be securely stored in the currency cassette subsequent to verification. The currency notes are transported to a first location 410 between the co-operable feed belts. In the depositing mode of operation, the primary feed belt 402 is rotated clockwise and the secondary feed belt 403 is rotated anti-clockwise. This rotation draws an item of media between the belts and these depositable items of media eventually follow the path shown by arrow A. A rotatable wheel 430 moves with the feed belt sub-system and rotates as the belts rotate. The wheel 430 carries flexible flappers 431 which extend radially outwards from the wheel and which rotate with the wheel. As an item of media moves in the direction shown by arrow A in FIG. 4 towards a stack position to join the stack 440 of currency notes in the storage cassette, the flappers urge the items of media against the primary feed belt to help ensure that the incoming item does not collide with any currency notes in the stack.

As illustrated in FIG. 4, with the primary feed belt 402 in place ready for depositing notes, the pusher plate 330 is moved backwards into the currency cassette somewhat so that the stack 440 of currency notes is positioned between an outer abutment surface 445 of the pusher plate 330 and a substantially linear portion of the feed belt. Incoming items of media can thus be stacked one-by-one in the currency cassette. The primary feed belt 402 is manufactured from a material which has a relatively low co-efficient of friction. This means that once items of media are drawn into the stack so that a lower edge 450 of the item abuts the base of the currency cassette, then the constantly rotating (or selectively rotating) primary feed belt 402 will slip against an outer surface of the next-to-be-picked currency note in the stack. The feed belt extends through a recess in the floor of the cassette to help prevent items from being pulled under the bottom of the belt.

Figure 5:
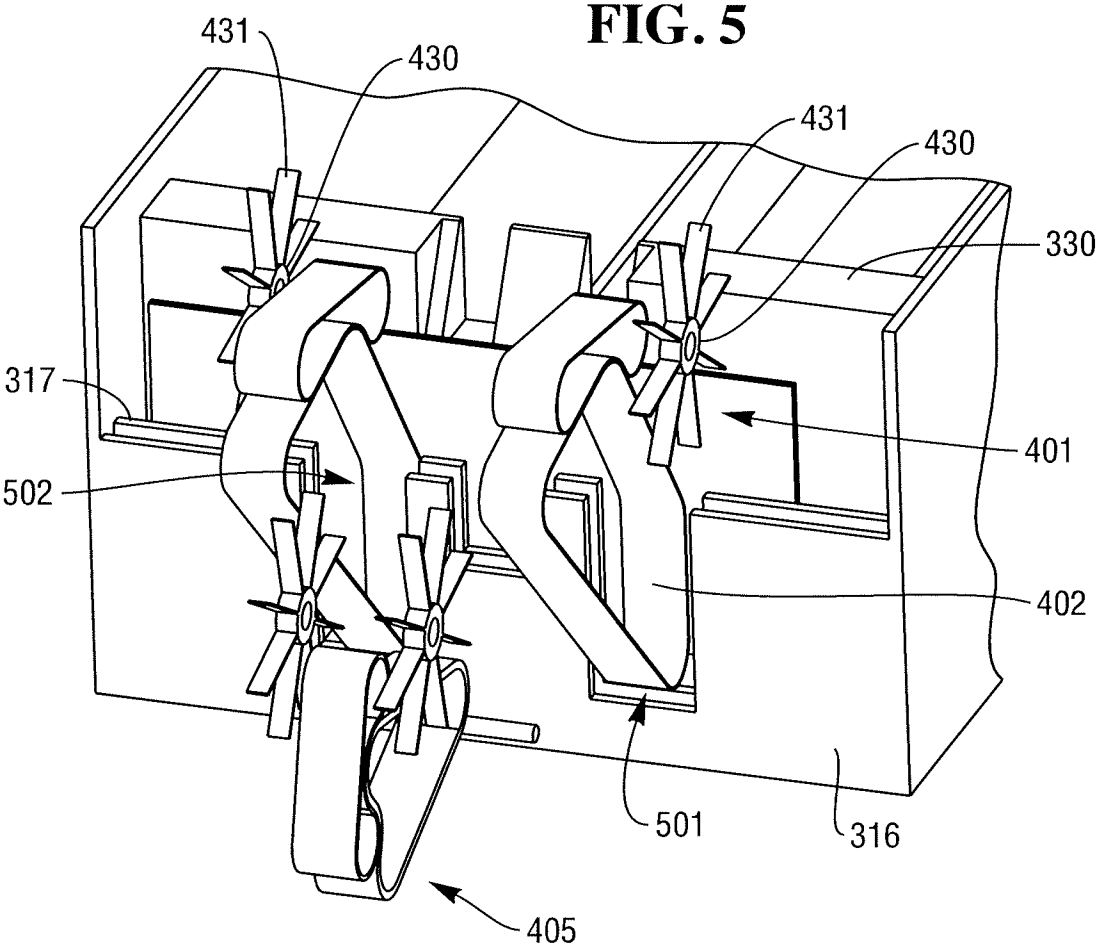
FIG. 5 illustrates another view of the belt members in a deposit mode of operation.

FIG. 5 helps illustrate the location of the feed belt sub-system 401 and dispense belt sub-system 405 in more detail in the deposit mode of operation. FIG. 5 also helps illustrate the spaced apart nature of the partial end walls 316, 317. The partial end walls 316, 317 include cut outs 501, 502 which enable ingress of the primary feed belts 402 of an adjacent pair of pairs of feed belt members. FIG. 5 also helps illustrate how there are two rotating wheels 430 and associated flappers 431 which help locate currency notes as they are being deposited in a stack between the partial end walls 316,317 and the pusher plate 330. In the deposit mode the remaining belt system 405 is held out of the way.

Figure 6:
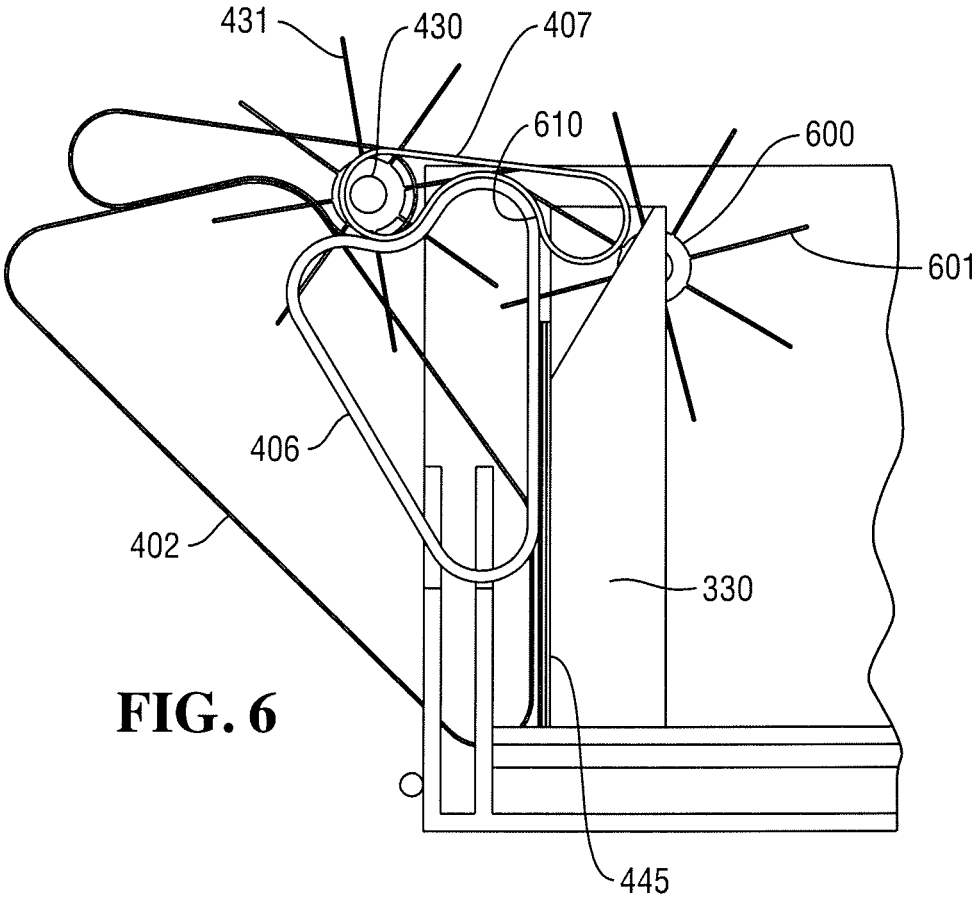
FIG. 6 illustrates a position of belt members in a dispense mode of operation via which items are picked from the cassette and can subsequently be dispensed from the terminal.

FIG. 6 illustrates the position of the two major belt systems in a dispense mode of operation. That is to say, with the co-operable dispense belts in their operational position. When currency notes are to be dispensed, the belt system 405 is pivoted towards the open end of the currency cassette and locked in place in a releasable fashion. When the primary belt 406 of the dispense belt system is pivoted into place, it pushes the pusher plate 330 slightly further back into the currency cassette than the primary belt 402 of the feed belt system. In addition, the material of the primary belt 406 of the dispense belt system has a co-efficient of friction which is greater than the co-efficient of friction of the primary belt 402 of the feed belt system. To dispense currency notes from the stack 445, the primary dispense belt is driven in an anti-clockwise fashion. This engages with an outer surface of the next-to-be-picked currency note in the stack and tends to lift the currency note upwards. As the currency notes are lifted wheels 600 (one shown in FIG. 6) which move with the dispense belts when they are pivoted are rotated in a clockwise fashion. Flappers 601 on the wheels 600 extend radially outwards from the wheel 600 and are flexible. As the wheel 600 rotates, these flappers 601 are urged against a side of an item of media being lifted out of the stack. This helps direct the item into a pinch point 610 between the rotating primary dispense belt and the co-operating rotating low friction dispense belt 407 (which operates as a retard belt) which is being driven in a clockwise direction shown in FIG. 6. The sliding contact between the high friction dispense belt 406 and the low friction retard belt 407 separates the items from each other and allows only one item at a time to pass.

Figure 7:
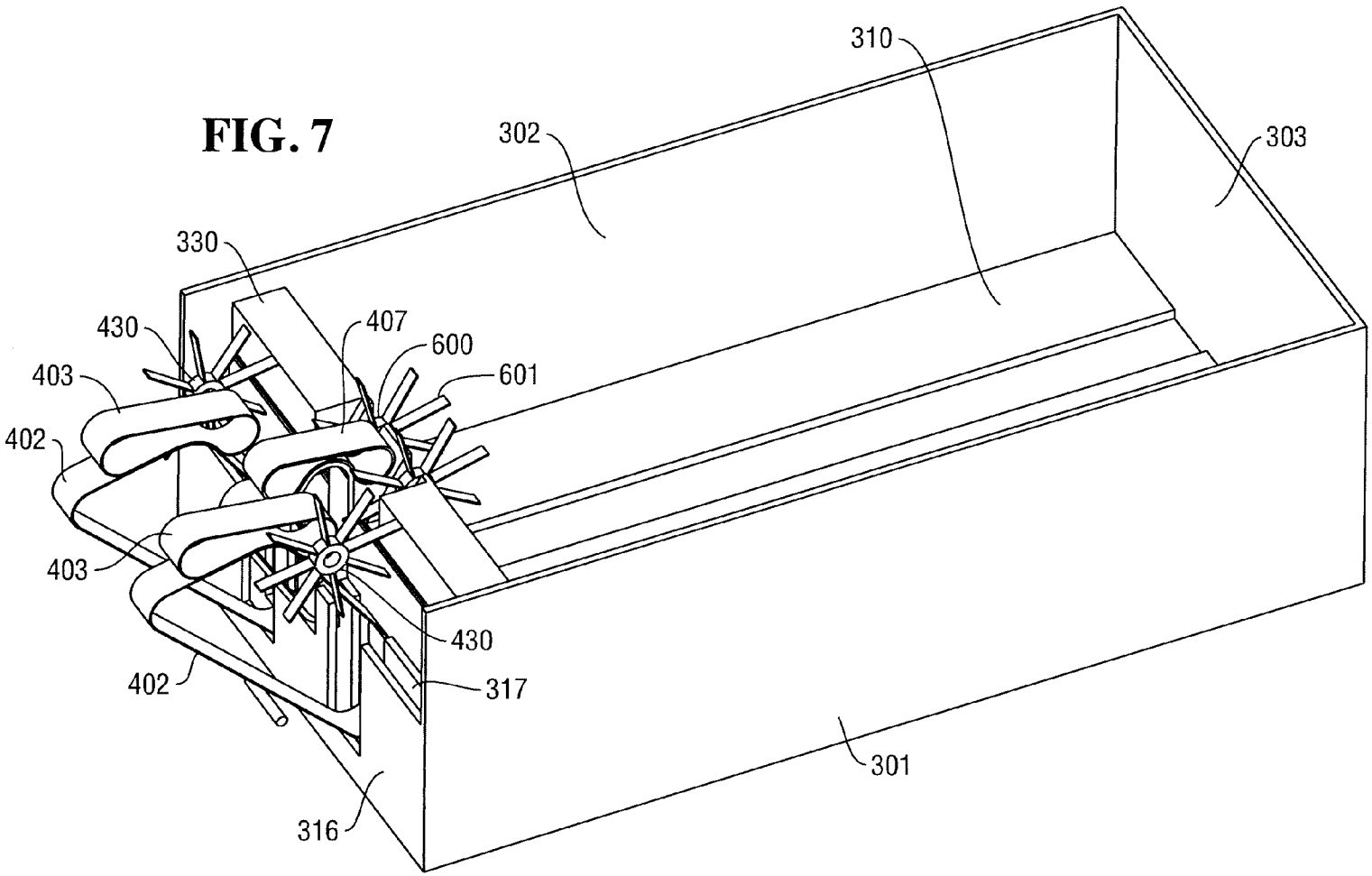
FIG. 7 illustrates another view of the belt members in the dispense mode of operation.

FIG. 7 illustrates another view of the two major belt systems in a dispense mode of operation in which the dispense belts are in an operational position in addition to the feed belts. As such, both the feed belts and dispense belts extend through respective cut outs in the partial side walls and pusher plate in the currency cassette to enable currency notes stacked in the cassette to be picked one-by-one. It will be appreciated that once a dispensing mode of operation has been halted, the various belt members may be pivoted back out of position (into the position shown in FIG. 3) to either allow a currency cassette to be closed prior to removal from the terminal, or prior to a new operation being carried out, whether that be a dispense or deposit operation.

According to certain embodiments of the present invention, a cassette is provided which has interface slots at one end for receiving certain drive belt mechanisms. When a cassette is duly inserted into a Self-Service Terminal, a shutter in an end of the cassette opens. Drive belt mechanisms pass through the openings and engage with the notes held within. The pressure plate within the currency cassette is pushed back slightly when one or more of the belt mechanisms is engaged to provide adequate force for deposit and/or dispense operations. When the cassette is removed from a dispenser/deposit module (which may be referred to as a recycler module) the drive belt mechanisms remain within the SST. The pressure plate will move slightly forward and the shutter will close.

According to certain embodiments of the present invention, to deposit items of media into the cassette, part of the belt system is first retracted out of the way about a hinge point near the shutter end of the bin. This leaves behind a low friction pair of belts to transport items into the cassette. Notes are stacked between the low friction belt and the pressure plate. A flapper wheel keeps the tops of the notes from catching on subsequent items entering the cassette as notes are stored one-by-one. The low friction nature of the belt allows slippage to occur between the belts and the stack of notes in the cassette.

To dispense notes out of the cassette, a high friction feeder belt is moved into position. The feeder belt moves slightly past the low friction belt to override the effects of the low friction belt. Items of media are fed upwards out of the document stack and are separated by a retard belt. Notes are picked up by the deposit belt as they exit the feeder belt mechanism and are then transported onwards. A flapper wheel travels with the feeder mechanism and helps to ensure that notes are directed into the feeder/retard belt contact point.

Certain embodiments of the present invention thus provide a relatively low cost cassette which can be utilized for dispense and/or deposit operations. This enables deposited notes to be re-used and thus recycled. The relatively low cost is achieved because the various mechanisms utilized during the dispense and deposit modes of operation are not part of the cassette assembly. Rather, these are part of the terminal assembly. Relatively high speed operation is also possible because of the friction feeding method of dispensing and depositing items.

Whilst certain embodiments of the present invention have been described with reference to a bunch present dispenser, a spray dispenser may alternatively be used.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for recycling items of media, comprising:

at least a pair of co-operable feed belt members that receive a depositable item of media at a first location and locate the depositable item at a stack position in a storage container; and at least a pair of co-operable dispense belt members that selectively pivot between an operational and non-operational position; wherein in the operational position, at least one of the dispense belt members is disposed to remove an item from the stack position and provide the removed item to the feed belt members, said feed belt members being arranged to locate an item of media received from the dispense belt members at said first location.

2. The apparatus as claimed in claim 1, further comprising:

at least one selectively rotatable wheel element comprising a plurality of flapper members that urge an item of media against a one of the feed belt members in a respective pair as the wheel element rotates.

3. The apparatus as claimed in claim 1, further comprising:

at least one selectively rotatable wheel element that pivots with the dispense belt members and comprises a plurality of flapper members that urge an item of media removed from the stack position between the dispense belt members in a respective pair.

4. The apparatus as claimed in claim 1, further comprising:

at least one dispense belt member in each pair of dispense belt members, when in the operational position, is urged towards a pusher plate element of the storage container and is located nearer to a stack of remaining items of media in the storage container than a location of a feed belt member.

5. An Automated Teller Machine (ATM) or Teller Cash Recycler (TCR) comprising the apparatus as claimed in claim 1, wherein each item of media is a currency note.

6. The apparatus as claimed in claim 1, further comprising:

at least a one feed belt member in each pair of feed belt members has a surface comprising a low co-efficient of friction.

7. The apparatus as claimed in claim 6, further comprising:

a portion of said at least a one feed belt member extends below a surface of a floor of the storage container.

8. The apparatus as claimed in claim 6, further comprising:

at least a one dispense belt member in each pair of dispense belt members has a surface comprising a co-efficient of friction greater than the low co-efficient of friction.

9. The apparatus as claimed in claim 6, further comprising:

a remainder one dispense belt member is a retard belt member comprising a co-efficient of friction less than said at least one dispense belt member and that moves in an opposite direction to the feed belt member in said operational position.

10. A method of recycling items of media, comprising the steps of:

storing an item of media in a storage container by receiving a depositable item of media at a first location and locating the depositable item in a stack position in the container via at least a pair of co-operable feed belt members; and dispensing an item of media from the storage container by selectively pivoting at least a pair of co-operable dispense belt members into an operational position and, via at least one of the dispense belt members, removing the item from the stack position and providing the item at the first location via the feed belt members.

11. The method as claimed in claim 10, further comprising the steps of:

locating at least one item of media in the stack position by rotating an endless belt comprising a one of said pair of feed belt members and allowing the endless belt member to slip against a contact surface of an item of media subsequent to the item of media being located at the stack position.

12. The method as claimed in claim 10, further comprising the steps of:

urging remaining items of media stored in a stacked arrangement in the storage container towards the stack position via a biased pusher plate element.

13. The method as claimed in claim 10, further comprising the steps of:

lifting at least one item of media from the stack position to thereby remove the item from the stack position, said lifting step comprising urging a portion of a rotating endless belt comprising the at least one dispense belt member against a contact surface of an item of media at the stack position, whereby friction moves said an item of media with the rotating endless belt.

14. The method as claimed in claim 13, further comprising the steps of:

separating items of media lifted from the stack position by rotating a further endless belt member comprising a remaining one dispense belt member moving in an opposite direction with respect to a rotation direction of said at least one dispense belt member.

* * * * *